US007402001B2

(12) United States Patent
Stassen et al.

(10) Patent No.: US 7,402,001 B2
(45) Date of Patent: Jul. 22, 2008

(54) SEAFLOOR-SURFACE COUPLING DEVICE

(75) Inventors: Yves Stassen, Issy les Moulineaux (FR); Michaël Gassert, Levallois Perret (FR); Olivier Moog, Mulhouse (FR); Alain Skraber, Berrwiller (FR)

(73) Assignee: Saipem S.A., Montigny le Bretonneux (FR)

( * ) Notice: Subject to any disclaimer, the term of this patent is extended or adjusted under 35 U.S.C. 154(b) by 189 days.

(21) Appl. No.: 10/566,893

(22) PCT Filed: Jul. 23, 2004

(86) PCT No.: PCT/FR2004/001968

§ 371 (c)(1),
(2), (4) Date: Feb. 1, 2006

(87) PCT Pub. No.: WO2005/021925

PCT Pub. Date: Mar. 10, 2005

(65) Prior Publication Data

US 2006/0177276 A1 Aug. 10, 2006

(30) Foreign Application Priority Data

Aug. 8, 2003 (FR) ..... 03 09798

(51) Int. Cl.
*E21B 17/05* (2006.01)

(52) U.S. Cl. ..... 405/224.3; 405/211; 166/367

(58) Field of Classification Search ..... 405/195.1, 405/211, 224.3; 166/350, 367
See application file for complete search history.

(56) References Cited

U.S. PATENT DOCUMENTS

| | | | | |
|---|---|---|---|---|
| 3,952,526 | A | 4/1976 | Watkins et al. | |
| 3,981,357 | A | 9/1976 | Walker et al. | |
| 4,078,605 | A | 3/1978 | Jones | |
| 4,634,314 | A * | 1/1987 | Pierce | 405/224.2 |
| 5,269,629 | A * | 12/1993 | Langner | 405/195.1 |
| 6,193,441 | B1 | 2/2001 | Fisher | |
| 6,672,804 | B1 | 1/2004 | Hallot et al. | |
| 6,746,182 | B2 * | 6/2004 | Munk et al. | 405/224.2 |

FOREIGN PATENT DOCUMENTS

| | | |
|---|---|---|
| FR | 2754021 | 4/1998 |
| WO | WO01/04454 | 1/2001 |
| WO | WO0101184 | 2/2001 |
| WO | WO0153651 | 7/2001 |

* cited by examiner

*Primary Examiner*—Tara L. Mayo
(74) *Attorney, Agent, or Firm*—Cohen Pontani Lieberman & Pavane LLP

(57) ABSTRACT

The present invention relates to a bottom-to-surface connection device comprising at least one undersea pipe or riser (1, 1*a*-1*b*) capable of including a single float (2, $\mathbf{2}_1$-$\mathbf{2}_7$), said float being connected at its bottom end to a junction device (8) creating a leaktight flexible joint between the bottom end of the float (2) and said riser (1*a*), the connection device being characterized in that said junction device (8) is interposed between and secured to a bottom portion (1*a*) of the riser going down to the sea bottom and a top portion of the riser passing through said float and rising to the surface, said junction device (8) comprising at least one first laminated abutment in the form of a body of revolution having a plurality of elastomer layers defining surfaces of revolution that are frustoconical in shape or ellipsoidal in section.

17 Claims, 11 Drawing Sheets

SEAFLOOR-SURFACE COUPLING DEVICE

PRIORITY CLAIM

This is a U.S. national stage of application No. PCT/FR2004/001968, filed on 23 Jul. 2004. Priority is claimed on the following application(s): Country: France, Application No.: 03/09798, Filed: 8 Aug. 2003; the content of which is incorporated here by reference.

The present invention relates to the known field of bottom-to-surface connections of the type comprising a vertical undersea pipe referred to as a "riser" connecting the sea bottom to the surface, preferably going to a floating support installed on the surface.

BACKGROUND OF THE INVENTION

Once the depth of water becomes large, a production field, and in particular an oil field, is generally worked from a floating support. The floating support generally includes anchor means for keeping it in position in spite of the effects of currents, winds, and swell. It also generally includes means for storing and processing oil and means for off-loading to off-loading tankers. Such floating supports are generally referred to as floating production storage off-loading (FPSO) supports. Numerous variants have been developed such as so-called SPARS which are long floating cigars held in position by catenary anchoring, or indeed "TLPs" which are platforms having tensioned anchor lines, said lines generally being vertical.

Wellheads are generally distributed over the entire field, and production pipes together with lines for injecting water and control cables are placed on the sea bottom converging on a fixed location, with the floating support being positioned vertically thereabove on the surface.

Some wells are situated vertically beneath the floating support and the inside of the well is then directly accessible from the surface. Under such circumstances, the wellhead fitted with its "Christmas tree" can be installed on the surface, on board the floating support. It is then possible from a derrick installed on said floating support to perform all of the drilling, production, and maintenance operations required on the well throughout its lifetime. The wellhead is then said to be "dry".

In order to keep the riser fitted with its dry wellhead substantially in its vertical position, it is necessary to exert upward traction thereon, which can be applied either by a tensioning system using cables and winches or hydraulic actuators installed on the floating support, or else by floats distributed along the riser and installed at various depths, or indeed by using a combination of those two techniques.

The riser as tensioned by these floats is guided, preferably relative to the floating support, by roller guides situated in a plane, preferably a single plane, enabling a riser to be held and guided relative to the floating support. Cable tensioning means acting as guide means can also be used.

FR 2 754 021 discloses a guide device for a riser provided with floats at its head end, the device including wheels enabling the riser to slide vertically, and also enabling it to turn about a horizontal axis so as to guide its horizontal displacements, so that horizontal translation movements of the riser substantially follow those of the floating supports. FR 99/10417 and WO/2001-11184 also disclose an improved guide device having wheels and friction skids disposed radially around the pipe. That device for holding and guiding the portion of a vertical riser that is underwater and near the surface, in particular within a drilling bay, serves to minimize the reaction forces between said riser and the support structure secured to the barge. Finally, various guide systems are known that involve tensioning by cable means.

Since the underwater depth of certain oil fields exceeds 1500 meters (m), and can be as great as 3000 m, the weight of risers over such depths requires forces to be used for holding them in position that can reach or exceed several hundreds of (metric) tonnes. "Can_type" buoyancy elements are used that are added to underwater structures, mainly to risers connecting ultra-great depths (1000 m-3000 m) to the surface. The underwater pipe then consists in a rising column having an underwater pipe assembled to at least one float comprising a coaxial can surrounding said pipe with said pipe passing therethrough.

The floats in question are of large dimensions, and in particular they have a diameter of more than 5 m, a length of 10 m to 20 m, and possess buoyancy that can be as great as 1000 tonnes, and in general they are disposed as a string one beneath another.

The float and the pipe are subjected to the effects of swell and current, but since they are connected to the FPSO at the surface, they are also indirectly subjected to the effects of wind. This gives rise to lateral and vertical movements that are large (several meters) for the riser-float-barge combination, particularly in the zone that is subjected to swell. These movements generate large differential forces between the riser and the float. In addition, the bending applied to the riser leads to bending moments that are extremely large in the zone where there is a change in second moment of area, as arises whenever there is a connection between the riser and a float.

In order to minimize the forces generated by current and swell and acting on the riser-float combination, floats are generally circular and are installed coaxially around the riser.

In addition, floats are generally secured to the riser in such a manner that the riser-float connection provides sealing to said float so that it can confine a filler gas. The solution that is commonly used consists in embedding the float in the riser by welding, both at the top and at the bottom of the riser. Large amounts of reinforcement are added to ensure that the connection is sufficiently strong.

At such a connection between the riser and a float, the second moment of area changes considerably on passing from the section of the riser to the section of the float.

These large variations in second moment of area lead to stresses being unevenly distributed, thereby generating very localized zones in which stresses can become unacceptable and can lead either to phenomena of sudden rupture, or else to phenomena of fatigue that in turn lead to cracks appearing, followed by collapse. These localized stresses require transition pieces to be used to reinforce the weak zone, said pieces generally being conical in shape and of large dimensions, and being referred to as "tapered joints". In some circumstances, these pieces can be as much as 10 m long, and even under the best of circumstances they require the use of very high performance steels. However, it is often necessary to make use of titanium which is 5 to 10 times as expensive as the best steels. In addition, such pieces are generally complex in shape and they need to be made with extremely high quality so as to provide the expected service throughout the lifetime of the equipment, which lifetime can commonly exceed 25 years.

U.S. Pat. Nos. 3,952,526 and 3,981,357 disclose junction systems between float-tanks and risers, in which use is made of parts made of elastomer material.

Those buoyancy systems make it possible to reduce the tensioning system situated on board the floating support, and they are generally distributed over a major fraction of the water depth, and in addition they present small buoyancy, generally a few hundreds of kilograms (kg) or possibly one or two tonnes.

The junctions are situated in the top portions of the floats, with the bottom portions of the floats generally being open. Such devices can transfer loads corresponding to lightening only a short length of the pipe, but they are not suitable for floats that are intended to support a very great length of riser, e.g. 500 m to 1000 m or even more, either alone or with the help of additional tensioning systems secured to the floating support, where such lengths are to be found in very deep offshore oil fields, i.e. at depths of more than 1000 m. The buoyancy needed to achieve tensioning solely by means of floats requires considerable forces to be transferred vertically and transversely, and said vertical forces, when applied to the head of the riser, can reach several hundreds of tonnes, and can in particular lie in the range 300 tonnes to 500 tonnes.

In WO/2001-04454 in the name of the Applicant, there is disclosed a novel type of junction between the riser and the can that serves to support and transfer high loads, while mitigating the drawbacks of the above-mentioned floats assembled around said pipe by the pipe being embedded therein.

Those (riser-float) junction means are simple, flexible, and mechanically reliable, and they reduce the phenomena of fatigue and wear due to the stresses acting on the junction which is subjected to loads of several hundreds of tonnes.

More particularly, patent WO/2001-04454 in the name of the Applicant describes a string of floats surrounding a vertical riser, each of said floats being fitted at at least one of its ends with a flexible joint comprising laminated abutments serving not only to provide sealing and to transfer loads, but also to decouple the second moment of area between the structures of said float and of said riser, so that there is practically no longer any zone in which stresses are concentrated at the transition between said float and said riser, thereby making it possible to reduce the complexity of the structure of the connection and also its own weight, thus significantly increasing the efficiency of the float, i.e. its buoyancy compared with its own weight.

Still more precisely, WO/2001-04454 describes junction devices between the riser and the float that comprise laminated abutments made up of layers of elastomer sandwiched between rigid reinforcements, being supported by plates comprising a first plate secured to the pipe and a second plate secured to the float, with said rigid reinforcements and elastomer layers being:

- either in the form of superposed washers;
- or in the form of tubes or cylinders that are coaxial and adjacent.

In WO/2001-04454, the bottom-to-surface connection is thus continuous in the zone where the float is installed, and the flexible junction serves to decouple the second moment of area of said float from that of said riser.

Current acts over the entire height of the riser, from the sea bottom up to its surface, but swell acts only in a zone close to the surface and decreases in substantially exponential manner so as to become practically zero at a depth of about 80 m to about 120 m. Thus, when using a string of mutually independent floats as described in WO/2001-04454, the top floats are subjected to considerable forces both laterally and vertically since the effects of swell are very large in zones close to the surface, while the bottom floats are subjected to much less stress. The unit dimensions of the floats are limited since they must be capable of being handled on board the barge and then introduced into the derrick in order to be lowered through the drilling bay. Thus, in very great depth, e.g. of 2000 m to 3000 m, the weight of the riser is such that a large number of floats is required, e.g. four or five floats presenting total buoyancy of 400 tonnes to 500 tonnes and extending over a height of about 100 m.

Each of the floats needs to be fitted with laminated abutments so as to minimize the transfer of stresses to the vertical riser which constitutes a highly critical element of the bottom-to-surface connection since it must be capable not only of withstanding very high tensions, but also it must be capable of withstanding the bursting pressure created by the fluid it transports, and also the implosion pressure created by the sea water.

This buoyancy, which is distributed as a multitude of independent floats, requires numerous laminated abutments to be used, each being of high cost. In addition, swell creates differential forces between pairs of adjacent floats, which forces are in addition to the considerable forces to which the riser is subjected at each discontinuity between the riser and a float.

It is thus desired to minimize the number of floats, but when the floats take on large dimensions, the transition zone between the bottom end of the float and the riser concentrates considerable horizontal thrust forces, thereby requiring said riser to be reinforced by a transition piece constituted by a conical forging of great length that is very difficult to fabricate and therefore very expensive, since it is generally made of very high performance metal, such as titanium. When there is only one float, it needs to be enormous when the depth of water is large, and the risk of failure associated with the transition piece then becomes very high and therefore unacceptable because of the high risk of pollution in the event of said bottom-to-surface connection failing or rupturing.

Furthermore, the entire riser behaves like a tensioned cord between the sea bottom and the point situated on the axis of the guide system relative to the floating support, and this leads to vibratory phenomena of the guitar-pendulum type. Water moving in the depth of the water creates drag effects on the structure of the riser and its floats, thereby generating large forces in varying directions, together with vibratory phenomena created by turbulence in the moving water separating from the riser.

Patent WO/2001-53651 in the name of the Applicant describes a device for stabilizing a bottom-to-surface connection of the type comprising a riser tensioned by a float, said tensioned riser being guided at a surface support, preferably in a single plane. Said stabilization device serves to avoid vibratory phenomena of the guitar-pendulum type appearing, thus avoiding localized accumulations of fatigue appearing in the steel as are usually to be encountered in the transition zone between the bottom of the float and the portion of the riser situated immediately below said float, said fatigue phenomena leading rapidly to cracking and then to rupture of the installation.

Nevertheless, that stabilizer device does not make it possible to avoid having recourse to reinforced transition pieces, generally conical forgings of steel or titanium, where titanium presents particularly high performance in terms of resistance to fatigue, but is particularly expensive because of its raw material cost and its difficulty of manufacture.

OBJECTS AND SUMMARY OF THE INVENTION

The object of the present invention is thus to provide a novel type of junction between a riser and a float that improves the fatigue behavior in the zone that is the most highly stressed at the bottom end of the float, thereby reducing the probability of a phenomenon of the riser and/or the junction means being destroyed at said level.

Another object of the present invention is to provide a novel type of junction between a riser and a float that is simple to put into place when installing a bottom-to-surface connection device.

Another object of the present invention is to provide a novel type of junction between a riser and a float that makes it possible to avoid having recourse to a reinforced transition piece in the zone between the bottom end of the float and the portion of the riser that is situated immediately therebelow.

Another object of the present invention is to provide the buoyancy of a bottom-to-surface connection device using a single float.

Another object of the present invention is to provide a novel type of junction between a riser and a float that makes it possible to monitor any possible cracking and thus to monitor loss of sealing from the riser in said junction zone and/or in the junction means themselves.

To do this, the present invention provides a bottom-to-surface connection device comprising at least one undersea pipe or riser including at least one float and possibly including only one float, said float being connected at its bottom end to a junction device creating a leaktight flexible joint between the bottom end of the float and said riser, the connection device being characterized in that said junction device is interposed between and secured to a bottom portion of the riser going down to the sea bottom and a top portion of the riser passing through said float and rising to the surface, said junction device comprising at least:

- a first forged body of revolution secured to the top end of said bottom portion of the riser, and forming an internal tubular duct section having substantially the same diameter as said bottom portion of the riser; and
- a second forged body of revolution secured to the bottom end of said top portion of the riser, and forming an internal tubular duct section having substantially the same diameter as said top portion of the riser;
- said first and second forged bodies being interconnected in flexible and leaktight manner by at least a first flange in the form of a body of revolution secured in leaktight and reversible manner to said second forged body and connected to said first forged body by at least a first laminated abutment in the form of a body of revolution, comprising a plurality of elastomer layers interposed between rigid reinforcements preferably made of metal defining surfaces of revolution having the same axis as the common longitudinal axis of revolution ZZ' of said first and second forged bodies and said first flange, said surfaces of revolution being frustoconical in shape or skew surfaces, such as surfaces of sections that are ellipsoidal, preferably spherical, or parabolic or hyperbolic or in shape.

The axis of symmetry and the axis of revolution ZZ' coincide when the junction device is in the rest position.

The term "surface of revolution of ellipsoidal, parabolic, or hyperbolic section" is used herein to mean a surface of revolution that is respectively ellipsoidal, parabolic, or hyperbolic and that is defined by two parallel section planes perpendicular to said axis of revolution ZZ'.

By means of the structure of the junction device, and in particular the shape of the layers of elastomer in said laminated abutments that are frustoconical or spherical in shape, the hinged connection of the present invention makes pivoting movements possible in association with a self-centering effect. As a result, overall, the stresses and the deformations generated at said laminated abutments and said forged bodies are minimized and make it possible to maintain or to restore a substantially aligned position for the top and bottom portions of said riser.

Thus, the junction device of the present invention is suitable for providing the junction between the riser and a single large tensioning float in a manner that is reliable, whereas the junction devices described in WO/2001-04454 are suitable only for providing a junction between the riser and small floats disposed as a string.

More particularly, a bottom-to-surface connection device of the invention comprises an undersea pipe or riser tensioned by at least one float constituted by a can presenting a cylindrical casing surrounding said pipe coaxially, located on the high underwater portion of said pipe, said pipe preferably being held and guided by a surface guide device located at a floating support and including a said junction device for said can, the connection device being characterized in that:

- said first forged body presents in its top portion an outer first surface of revolution that is preferably frustoconical in shape or of ellipsoidal section; and
- said second forged body of revolution secured to the bottom end of said top portion of the riser, preferably by welding, presents in its bottom portion a bottom first surface; and
- said first flange presents:
  - an inner first surface of revolution of frustoconical shape or of ellipsoidal section, said inner first surface of the first flange and said outer first surface of the first forged body being situated facing each other and co-operating elastically and in leaktight manner via a said first laminated abutment in the form of a body of revolution that is frustoconical in shape or respectively of ellipsoidal section, comprising a plurality of layers of elastomer sandwiched between reinforcing sheets of rigid material, in particular steel sheets, bonded to said inner first surface and said outer first surface thus bonding together said first flange and said first forged body; and
  - at least a portion of a top surface of said first flange co-operating in leaktight manner, preferably via at least one O-ring, with said bottom surface of said second forged body of revolution, said top surface portion of said first flange and said top surface of said second forged body being secured to each other in leaktight and reversible manner, preferably by bolting; and
- said outer casing of the float being secured to a top surface of said second forged body or to a top surface of a second flange in the form of a body of revolution having a bottom surface, itself bonded in leaktight and reversible manner, preferably by bolting and via at least one O-ring, to a portion of said top surface of revolution of said first flange.

Preferably, said top and bottom surfaces of said first and second flanges and of said second forged body are annular plane surfaces or surfaces of revolution, said first and second forged bodies and said first flange, and where appropriate said second flange, and said annular plane surfaces or surfaces of revolution all have a common axis of symmetry or of revolution ZZ' when in the rest position.

Still more particularly, said second forged body of revolution includes in its bottom portion an outer second surface of frustoconical shape or preferably of ellipsoidal section, and said outer second surface of revolution is situated facing and co-operates elastically and in leaktight manner with an inner second surface of revolution of frustoconical shape or respectively of ellipsoidal section, said inner second surface being situated in the top portion of said second forged body, and said inner second surface being connected to said outer second surface via a second laminated abutment in the form of a body of revolution constituted by a plurality of elastomer layers sandwiched between rigid reinforcing sheets, in particular of steel, that are frustoconical in shape or respectively of ellipsoidal section, and that are bonded to said outer second surface and to said inner second surface.

In a first particular variant, said first abutment and where appropriate said second abutment, said outer first surface of the first forged body, said inner first surface of the first flange, and, where appropriate said outer second surface of revolution of the second forged body, and said inner second surface of revolution of the first forged body are all frustoconical in shape about the same said axis of revolution ZZ', with an angle of the apex β lying in the range 30° to 80°, preferably in the range 40° to 70°, the apexes of the various frustoconical surfaces being situated below said frustoconical surfaces, and the various frustoconical surfaces either sharing a common angle at the apex β or a common apex C.

It will be understood that either said truncated cones flare upwards and converge substantially on a single point C, in which case they present an angle at the apex β that varies from one cone to another, or else they have the same angle at the apex, with their apexes then being distributed substantially along said axis of revolution ZZ'.

In a preferred second particular variant, said first abutment, and, where appropriate said second abutment, said outer first surface of the first forged body, said inner first surface of the first flange, and, where appropriate said outer second surface of revolution of the second forged body, and said inner second surface of revolution of the first forged body are all of ellipsoidal section, preferably of spherical section, all being substantially centered on the common point ○ situated above said surfaces and on said axis of revolution ZZ'.

By means of its makeup interposed between the two riser portions and comprising various forged bodies and flanges secured to one another, the junction device of the present invention is particularly easy to put into place when installing the bottom-to-surface connection device.

Furthermore, and above all, the junction device of the present invention provides a leaktight flexible joint that is particularly effective, since during movement of the float associated with the riser due to swell and current, the articulated connection between the float and the riser can accommodate pivoting while keeping the bottom portion of the riser in tension. The preferably spherical shape of said first laminated abutments in accordance with the invention has a self-centering effect, and the entire tensioning force created by the float (which can exceed 500 tonnes) is transferred to the riser in a manner that is uniformly distributed merely by deformation. When the connection device takes on an angle α, the deformation in the laminated abutments remains substantially uniform and the stresses generated within the various components of the laminated abutments also remain substantially uniform.

Said angle α that results from the laminated abutment deforming preferably lies in the range 0° to 5°.

It will be understood that when it is stated in the present application that the axes of revolution of the various components and surfaces are the same, it should be understood that the axes of revolution of said first and second forged bodies coincide and likewise the axes of revolution of the flanges and of the surfaces of revolution also coincide, providing the structure is at rest, i.e. when there is no bending, as is made possible by said flexible joint device of the invention.

Said laminated abutment enhances the self-centering effect and the load take-up effect of the first laminated abutment, while also enhancing the primary sealing function so that in an advantageous embodiment, said first and second forged bodies and said first flange define between them a first internal chamber which preferably co-operates with means for monitoring the pressure inside said chamber.

More precisely, said first chamber is defined by the top portion of said first forged body and by the free portions of said bottom surface of revolution of said second forged body, said concave inner first surface of revolution of said first flange, and said convex outer second surface of revolution of said second forged body.

Said inner chamber fitted with pressure monitoring means makes it possible to monitor degradations and/or losses of sealing through one of the laminated abutments, or indeed cracking in one of the components of the junction device including the leaktight joint, and/or the riser. When the pressure in said chamber varies, the operators are warned of an imminent danger and can take action, given that the general structure of said junction device includes a plurality of bodies and flanges that are secured to one another in reversible manner.

In an advantageous embodiment, said top surface portion of the first flange and said bottom surface of the second forged body, and where appropriate said bottom surface of the second flange, are all plane annular surfaces.

In a preferred embodiment of the invention, said outer casing of the float is secured to an internal second pipe of greater diameter than said riser, said internal second pipe preferably being a reinforced pipe of thickness greater than said riser, and it includes a said second flange in the form of a body of revolution to which the bottom end of said outer casing of the float and the bottom end of said internal second pipe are secured, preferably by welding, said second flange surrounding said second forged body so that a second inner chamber is defined by an inner surface of revolution of said second flange having the same axis of revolution ZZ', by said top surface of revolution of said second forged body), by the cylindrical outer surface of said top portion of the riser and the cylindrical inner surface of said internal second pipe, and by a closure flange at the top ends of said internal second pipe and of said top portion of the riser, said second chamber preferably co-operating with means for monitoring the pressure inside said second chamber.

This embodiment makes it possible to monitor and reveal leaks caused by cracking in the various components of the junction device and the risers and pipes, or indeed mere failures to achieve sealing, while still ensuring that the buoyancy of the float is maintained.

Also preferably, said internal second pipe extends above said float, preferably in the form of a reinforced pipe of thickness greater than said riser which it surrounds, and preferably a holding and guide device serves to guide said internal second pipe relative to said floating support.

Furthermore, said reinforced internal pipe extends above said riser and co-operates with the holding and guiding device so as to take load off the top portion of the riser in its underwater portion and in particular so as to avoid phenomena of said top portion buckling as a result of the pressure and the temperature of the fluid that it might be conveying.

According to the present invention the top end of the float is secured to the top portion of the riser or of said internal second pipe via a rigid junction.

In an advantageous embodiment, said float is a single float extending over a length of 40 m to 100 m in order to confer buoyancy enabling the entire bottom-to-surface connection to be tensioned, said float preferably being made up of segments that are assembled to one another, each constituted by a cylindrical box, which boxes are preferably individually sealed, and secured mechanically to one another in the longitudinal direction ZZ'.

Also advantageously, the buoyancy of said undersea pipe is provided by said float without adding any additional tensioning system that is secured to the floating support.

Installing the junction device of the invention with a leaktight flexible joint at the bottom of the float does not significantly alter the behavior of the connection device concerning vibration phenomena of the pendulum-guitar type described in WO/2001-53651, thereby advantageously eliminating the appearance of such phenomena, providing the device of the invention includes stabilizer means in the bottom portion of the float having the effect of increasing the mass of water it entrains when it moves, or lowering the center of gravity of the top portion of the pipe in the vicinity of the float.

More particularly, the device of the invention includes stabilizer means comprising a helical ramp surrounding said float in its bottom portion close to its bottom end, and/or an additional peripheral mass situated around the bottom portion of the float.

BRIEF DESCRIPTION OF THE DRAWINGS

Other characteristics and advantages of the present invention appear in the light of the following detailed description given with reference to the accompanying figures, in which.

DETAILED DESCRIPTION OF THE PRESENTLY PREFERRED EMBODIMENTS

Figure 1:
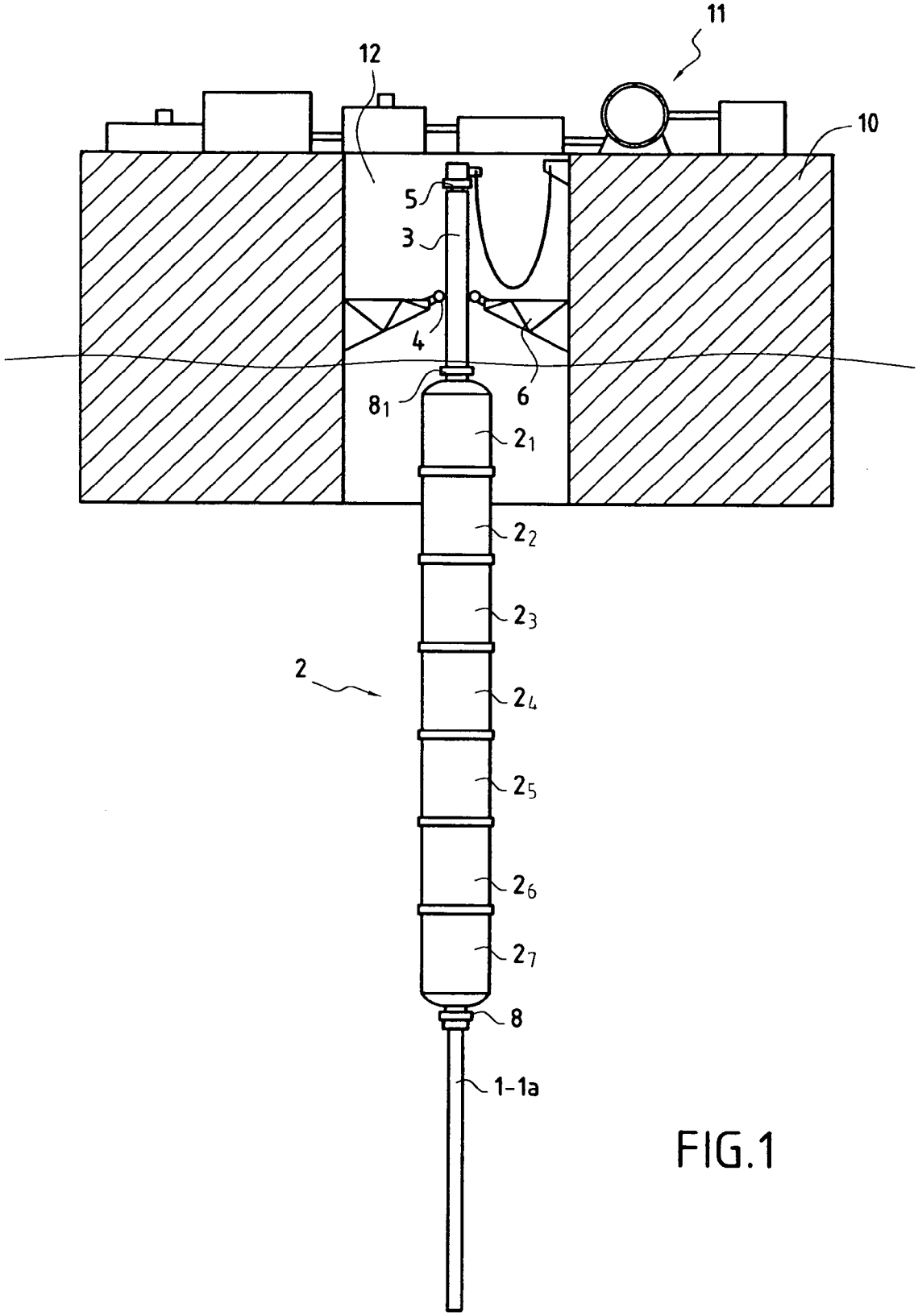
FIG. 1 is a side view of a bottom-to-surface connection device of the invention.

FIG. 1 shows a bottom-to-surface connection device of the invention comprising a riser 1 having a box-type float 2 made up of segments $\mathbf{2}_1$-$\mathbf{2}_7$ suitable for being handled on board a barge or floating support 10 in order to be assembled, in particular within a drilling bay 12, and thus building up a single float. More precisely, the segments are constituted by cylindrical boxes $\mathbf{2}_1$-$\mathbf{2}_7$ each of which is individually hermetically sealed, the boxes being mechanically secured to one another in the longitudinal direction ZZ'. Said float 2 extends over a length of 40 m to 100 m in order to confer buoyancy that enables the entire bottom-to-surface connection to be tensioned.

The float 2 is thus constituted overall by a can presenting an essentially cylindrical casing 20 disposed coaxially around the top portion 1*b* of the riser 1, at the underwater top end of the pipe 1. The riser opens out at the surface inside a drilling bay 2 of a floating support or barge 10 that supports processing equipment 11. The bottom portion 1*a* of the riser 1 that extends below the float 2 is of substantially constant diameter down to the sea bottom.

The top portion 1*b* of the riser above the float 2 is surrounded by a reinforced pipe 3 secured to said float 2. Thus, it is said reinforced pipe 3 that is held and guided by a guide system comprising a known roller device 4 secured to a structure 6 connecting it to said barge 10. The guide device 4 allows the reinforced pipe 3 to slide, and thus allows said riser to slide along its longitudinal axis, and it guides it lateral movements in a horizontal plane perpendicular to said longitudinal axis ZZ' of the riser 1.

In FIG. 1, there is shown diagrammatically a junction device 8 creating a leaktight flexible joint between the bottom end of the float 2 and said riser 1. The top end of the float 2 is secured to said reinforced pipe 3 via a rigid junction $\mathbf{8}_1$.

Figure 2:
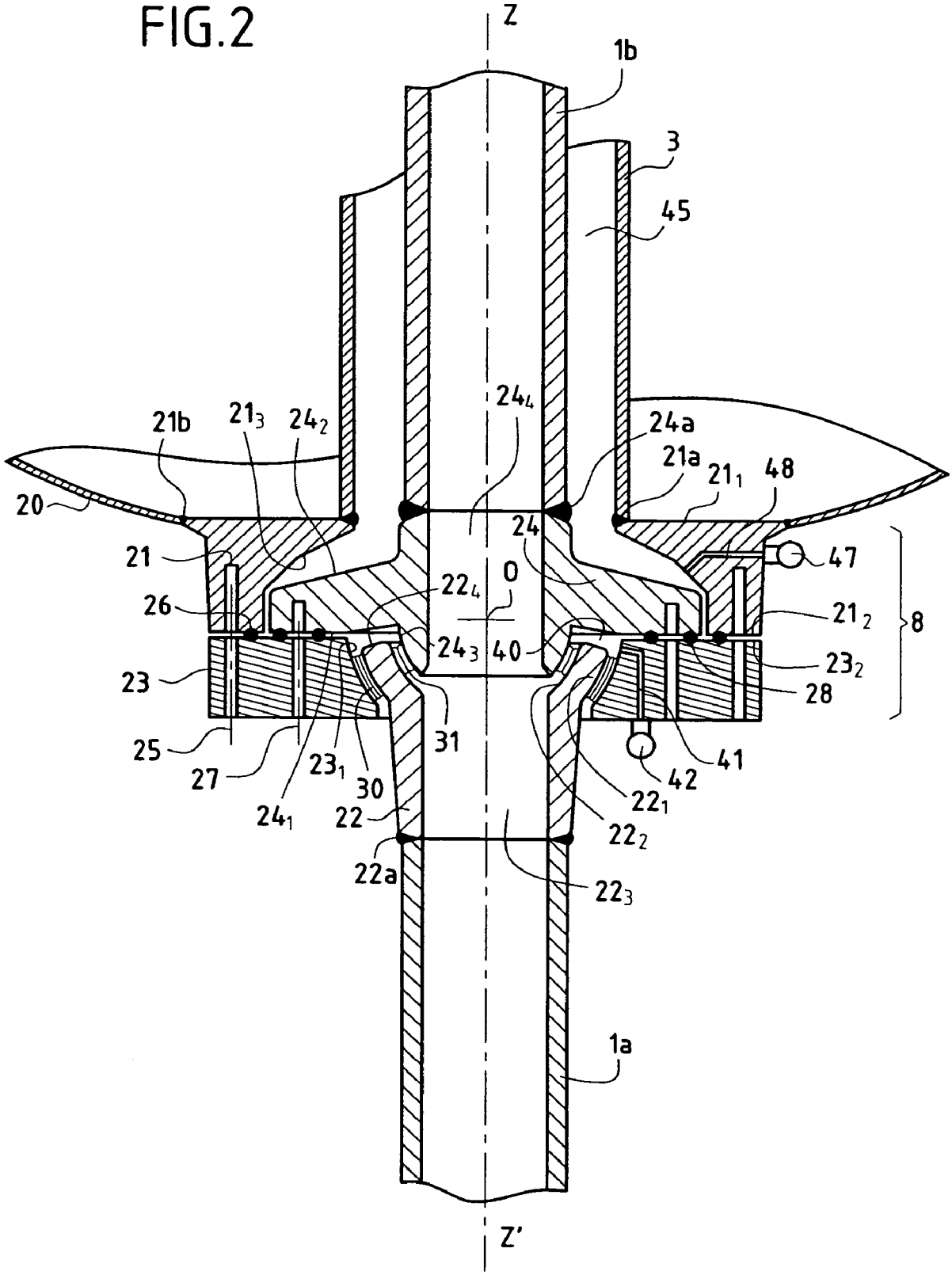
FIGS. 2 and 3 are section views through the bottom portion of the float, showing the various components of a junction device of the invention having a flexible leaktight joint.
Figure 3:
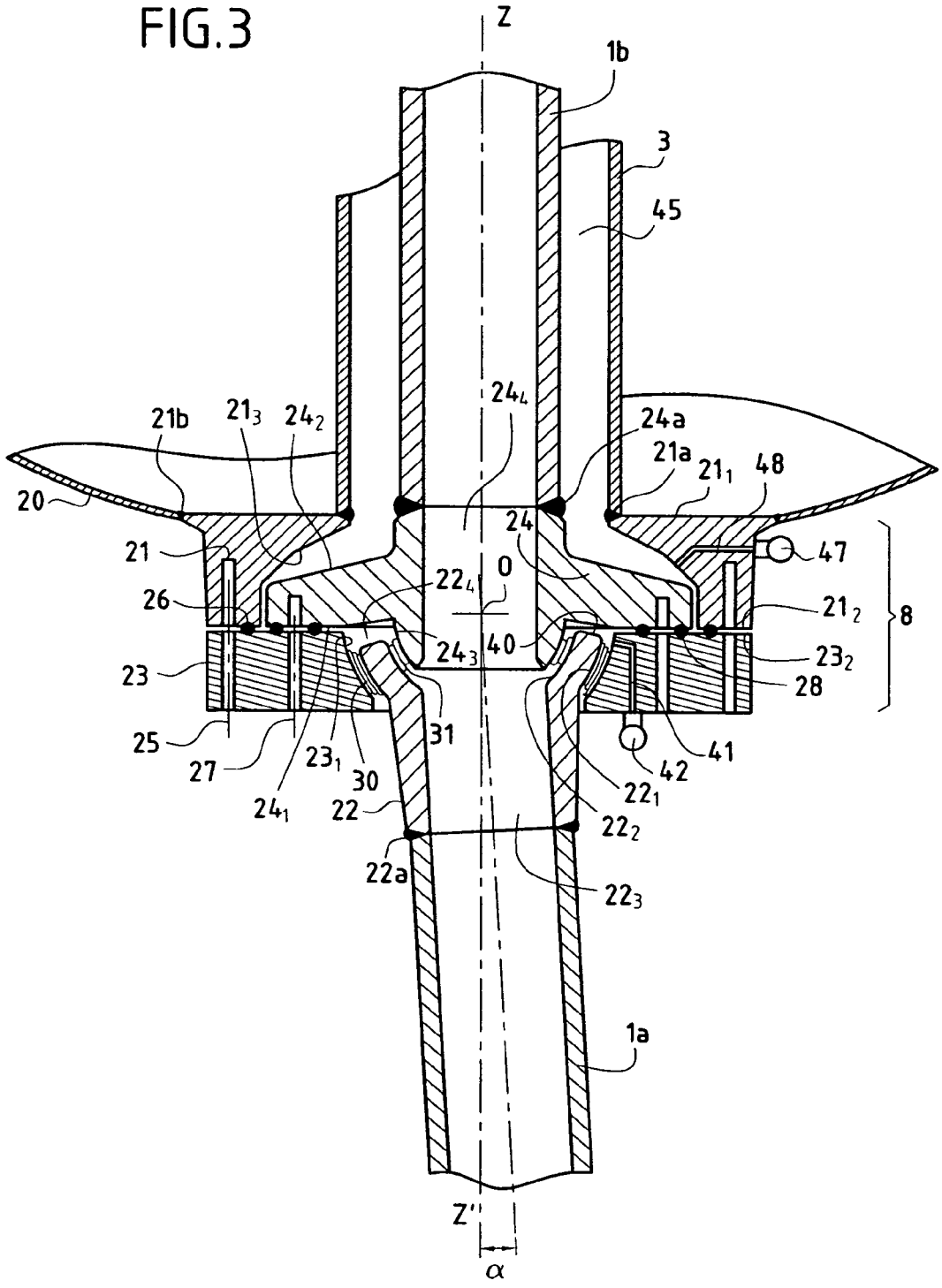

FIGS. 2 and 3 show a preferred embodiment of a junction device 8 of the invention having a leaktight and flexible joint.

The junction device 8 of the invention is interposed between a bottom portion 1*a* of the riser going down to the sea bottom and a top portion 1*b* of the riser passing through the float 2 and rising to the surface.

The term "shape of spherical section centered on ○" is used below to mean a shape that can be inscribed in a casing of spherical section constituted by a surface of revolution defined between two parallel horizontal section planes and situated in the same hemisphere of a sphere of center ○, said center ○ being placed above said parallel horizontal section planes.

The junction device 8 in FIGS. 2 and 3 comprises:

- a first forged body of revolution 22 having its bottom end secured by welding 22*a* to the top end of the bottom portion 1*a* of the riser, this first forged body of revolution 22 forming an internal tubular duct section $\mathbf{22}_3$ having substantially the same diameter as the said bottom portion 1*a* of the riser to which it is secured by a complete peripheral weld 22*a*; said first forged body 22 presents in its top portion a flared shape forming a convex outer first surface of revolution $\mathbf{22}_1$ in the shape of a spherical section centered on a point ○ situated substantially on the longitudinal axis ZZ' of said riser, and a concave inner second surface of revolution $\mathbf{22}_2$ in the shape of a spherical section of diameter greater than the inside diameter of the riser 1 and of diameter smaller than said convex outer surface of revolution $\mathbf{22}_1$, and substantially centered on the same point ○;
- a second forged body of revolution 24 whose top end is welded at 24*a* over its entire periphery to the bottom end of said top portion 1*b* of the riser, said second forged body of revolution 24 forming an internal tubular duct section $\mathbf{24}_4$ of substantially the same diameter as said top portion 1*b* of the riser; said second forged body of revolution 24 further presenting in its bottom portion a bottom first surface $\mathbf{24}_1$ comprising a plane annular portion, and a convex outer second surface $\mathbf{24}_3$ in the shape of a spherical section of diameter smaller than that of said spherical section of said concave internal surface $\mathbf{22}_2$, substantially centered on the same point ○ as said other spherical section surfaces $22_1$, $22_2$, said convex outer second surface $24_3$ being situated at a level below said bottom first surface $24_1$ and constituting the bottom end of the outer surface of said second forge body 24;

a first flange 23 in the form of a body of revolution presenting a concave internal first surface $23_1$ of revolution of spherical section substantially centered on the same point ○ as said other spherical section surfaces $22_1$, $22_2$, and $24_3$, and said first flange 23 also presents an annular plane top surface $23_2$; and a second flange 21 in the form of a body of revolution having an annular plane bottom surface $21_2$ together with an annular plane top outer surface $21_1$ and an inner surface of revolution $21_3$.

Said second flange 21 in the form of a body of revolution provides a connection between the bottom end of the cylindrical outer casing 20 of the float 2 and an internal pipe 3 in said float that contains said top portion 1*b* of the riser coaxially therein. Said internal pipe 3 is a reinforced pipe of greater diameter and greater thickness than the riser 1 and it is extended at its top end to protect the riser 1 in the vicinity of the holder and guide device 4 in the drilling bay 12. Said second flange 21 is secured to the bottom end of the outer casing 20 by a peripheral weld 21*b* and to the bottom end of said internal pipe 3 by a peripheral weld 21*a*. Said second flange 21 surrounds said second forged body 24.

The various forged bodies 22 & 24 and flanges 21 & 23 are assembled together and they co-operate as follows in order to provide a junction device having a leaktight and flexible joint:

said concave inner first surface $23_1$ of the first flange 23 and said convex outer first surface $22_1$ of the first forged body 22 co-operate elastically and in leaktight manner via a first laminated abutment 30 in the form of a body of revolution in the shape of a spherical section centered substantially on the same point ○, comprising a plurality of layers of elastomer sandwiched between reinforcement of steel sheets with end sheets bonded to said concave inner first surface $23_1$ and said convex outer first surface $22_1$, thus providing a direct connection comprising a leaktight and flexible joint between said first flange 23 and said first forged body 22;

said annular plane top surface $23_2$ of the first flange 23 is secured in leaktight and reversible manner to the plane portion of the bottom surface $24_1$ of the second forged body 24 by bolting in holes 27 in said first flanges 23 and forged bodies 24, with sealing being provided by interposed O-rings 28;

said plane top surface $23_2$ of said first flange 23 is likewise secured in leaktight and reversible manner to the annular plane bottom surface $21_2$ of said second flange 21 by bolting in holes 25 in said first and second flanges 21 and 23, with sealing being provided by O-rings 28 interposed between said surfaces $23_2$ and $24_1$; and said concave inner second surface of revolution $22_2$ in the shape of a spherical section of said first forged body 22 is connected to said concave outer second surface $24_3$ of said second forged body 24 via a second laminated abutment 31 in the form of a body of revolution constituted by a plurality of layers of elastomer sandwiched between rigid reinforcements of steel sheet, the end reinforcements being bonded to said convex outer second surface $24_3$ and to said concave inner surface $22_2$, thus providing a direct, flexible, and leaktight connection between the two forged bodies 22 and 24.

Laminated abutments made up of layers of elastomer and rigid reinforcement are well known to the person skilled in the art.

It will be understood that said concave and convex surfaces of spherical section have their concave sides facing upwards and their convex sides facing downwards, i.e. they can be inscribed in a hemisphere having a bottom horizontal section.

In FIGS. 2 and 3, a first leaktight internal chamber 40 is defined by the top margin $22_4$ of said first forged body 22 and the sides of said first and second laminated abutments 30 and 31 and the free portions of the bottom surfaces $24_1$ of the second forged body 24, said concave inner first surface of revolution $23_1$ of the first flange 23, and said convex outer second surface of revolution $24_3$ of the second forged body 24. The chamber 40 is fitted with pressure monitoring means, e.g. an external pressure gauge 42 connected to the chamber 40 via a duct 41 passing through the flange 23, or a pressure sensor connected to the control cabin of the barge.

A second leaktight chamber 45 is defined by the top closure flange 5, the cylindrical outer surface $1_1$ of the top portion 1*b* of the riser, the cylindrical inside surface $3_1$ of the reinforced internal pipe 3, and the inner surface of revolution $21_3$ of the second flange 21 and the top outer surface $24_2$ of the second forged body 24. The second chamber 45 also co-operates with an external pressure sensor or gauge connected to said chamber via a duct 48 passing through the flange 21.

During movements of the float 2 associated with the riser 1, due to swell or to current, the jointed connection device 8 between the float and the riser allows a certain amount of pivoting to take place, while keeping the bottom portion 1*a* of the riser under tension. The spherical shape of said first and second laminated abutments 30 and 31 has an automatic centering effect, and the entire tensioning force created by the float (which might displace 500 tonnes) is transferred to the riser merely by said laminated abutments being deformed in compression.

The second laminated abutment 31 acts mainly as a primary seal, with the major fraction of vertical load transfer taking place via the first laminated abutment 30.

Said reinforced pipe 3 at the top of the float 2 can be assembled to an internal second pipe 3 inside the float, which second pipe need not be reinforced, with assembly being implemented in conventional manner using stiffeners, since the forces in this zone are much smaller than in the bottom portion.

Figure 4:
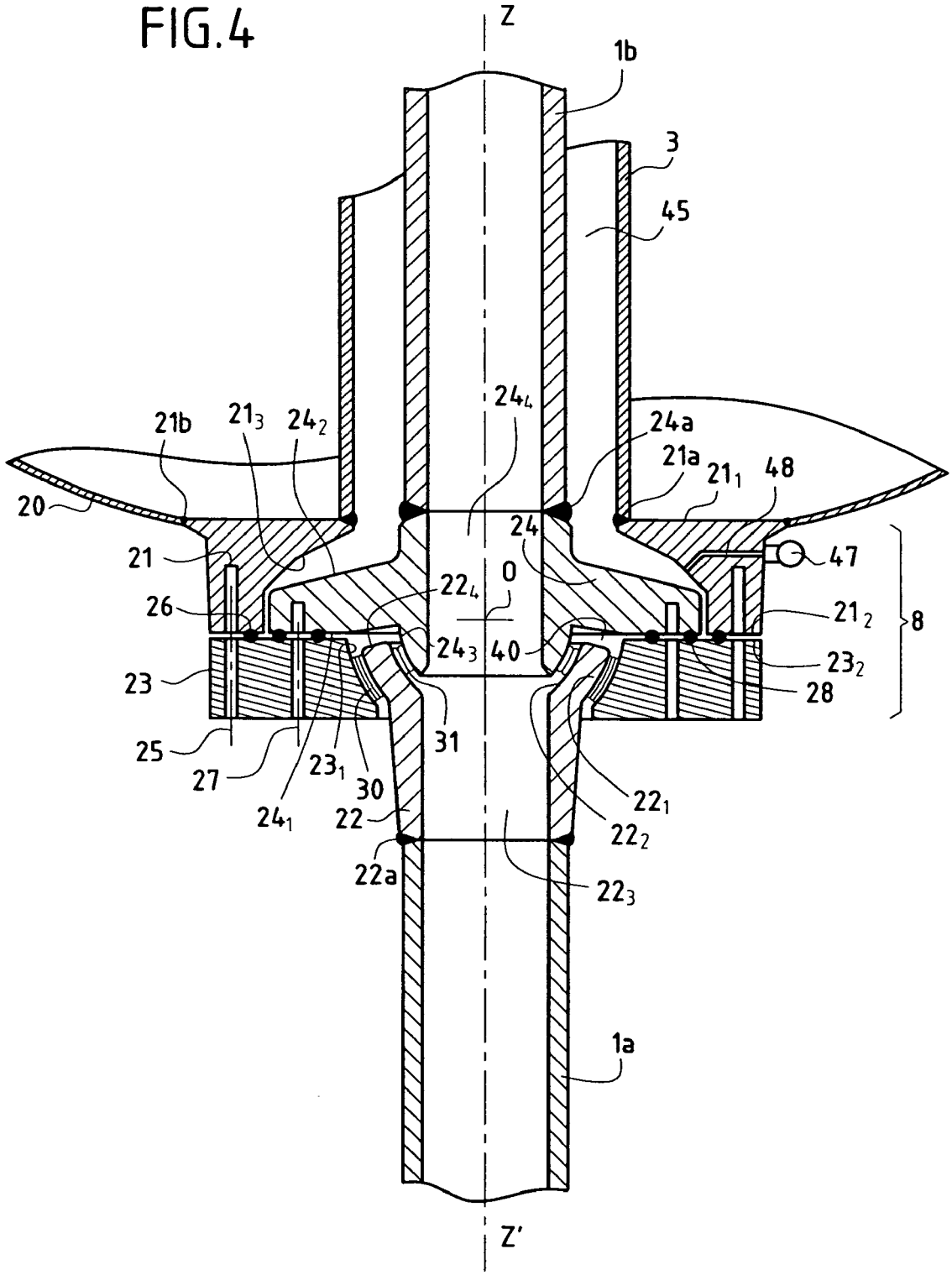
FIGS. 4 and 5 are section views of two other embodiments of a junction device of the present invention having a leaktight flexible joint.

In a simplified version of the invention shown in detail in FIG. 4, the second laminated abutment 31 providing primary sealing as shown in FIG. 3 is omitted. The first laminated abutment 30 then both provides primary sealing and also transfers vertical and horizontal loads between the float and the riser. In this simplified version, the pressure monitoring chamber 40 of FIGS. 2 and 3 no longer exists, and it is therefore not possible to detect leaks therein.

Figure 5:
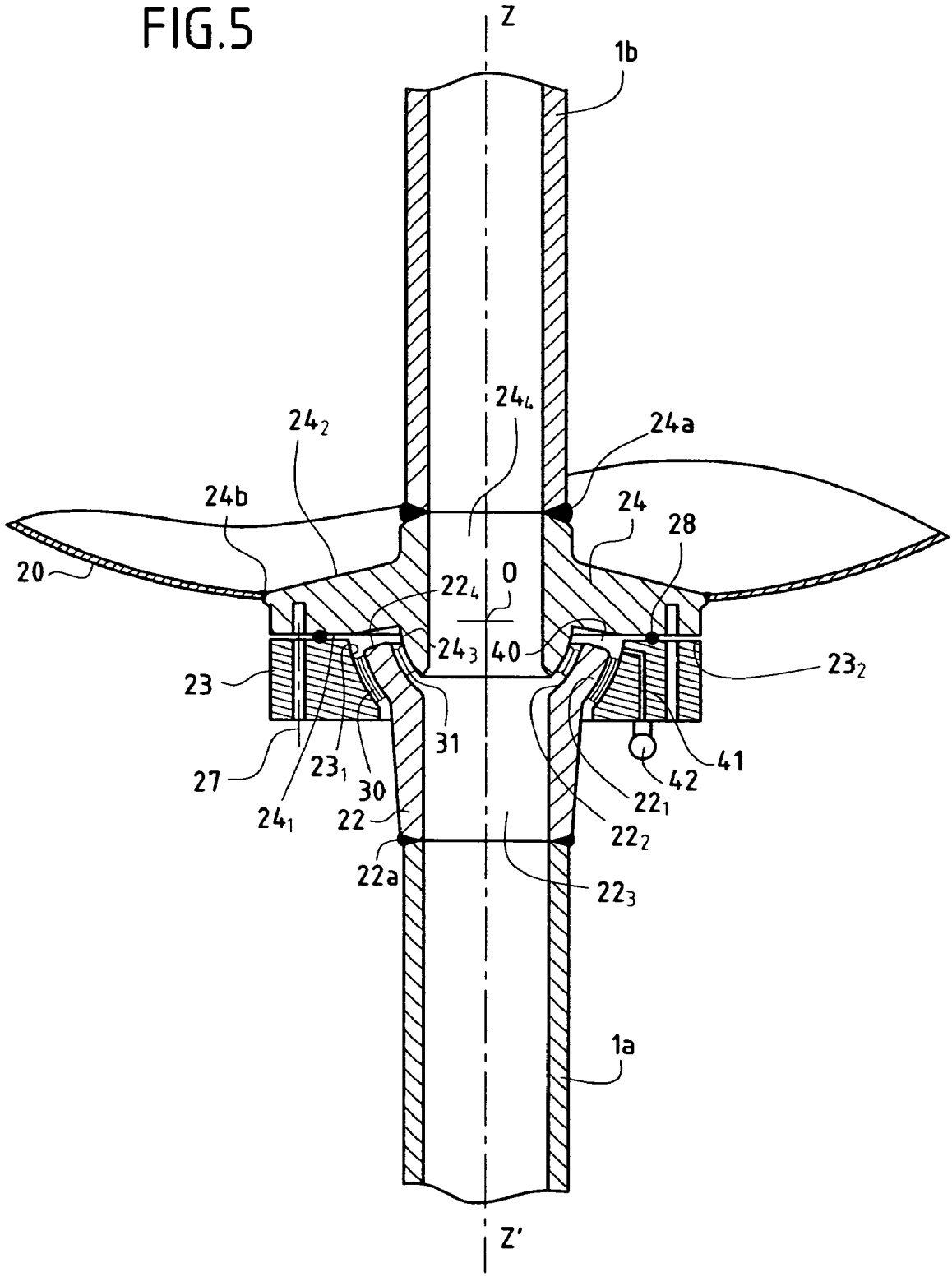

In another simplified version of the invention shown in detail in FIG. 5, the second forged body 24 and the second flange 21 of FIGS. 2 and 3 are combined in a single forged body 24 having the bottom end of the outer casing 20 of the float 27 and the bottom end of the riser 1*b* welded directly to its top surface $24_2$ at 24*b*; in this configuration there is no longer an internal second pipe 3 surrounding said top portion 1*b* of the riser 1 coaxially. In this simplified version, the pressure monitoring chamber 45 of FIGS. 2 and 3 no longer exists, and it is therefore not possible in simple manner to detect locally any leaks from the riser in this zone.

FIG. 3 shows the assembly inclined at an angle of value $\alpha$ between the top portion 1*b* and the bottom portion 1*a* of the riser.

In the descriptions of FIGS. 2 to 4, the laminated abutments as described as being spherical and as co-operating with the spherical bearing surfaces of the forged and machined flanges and bodies 22, 23, and 24, the set of spheres and spherical bearing surfaces then being described as having a common centers ○.

In fact, when fabricating those elements, it can be considered that the point ○ is indeed common to each of the above-described spherical bearing surfaces; however, during installation on site, the laminated abutments are subjected to considerable forces, which may reach or exceed 500 tonnes, so they deform in very significant manner, e.g. by a few centimeters, and consequently the reference centers ○ of some of the components moves vertically relative to the reference centers of other components. Nevertheless, it can be considered that in fact the reference centers of the various spherical bearing surfaces remain substantially centered at the common point ○. Similarly, during tilting through an angle α, as shown in FIG. 3, the various reference points of the spherical bearing surfaces are shifted sideways a little, but nevertheless remain substantially centered on ○.

Figure 6:
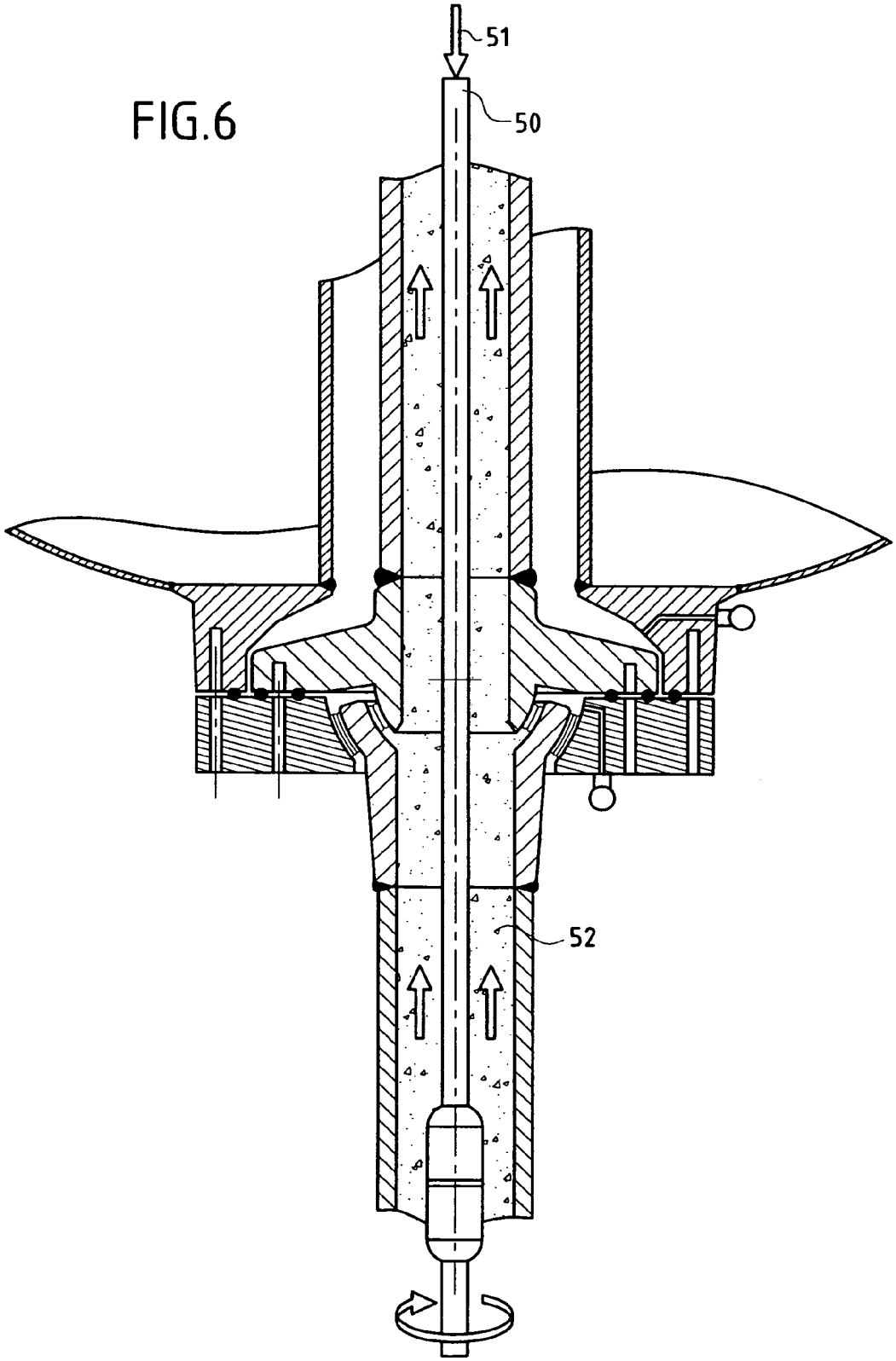
FIG. 6 is a section view through a device of the invention as shown in FIG. 2, further including a drill string during a well-drilling operation.

FIG. 6 shows the device of the invention during a "single-casing" drilling operation. A string of rods 50 with a drilling tool installed at its bottom end is set into rotation. Drilling mud is injected under pressure inside the drill string 51, and then rises together with drilling debris up the annular space 52 between the riser 1 and the drill string 50.

Figure 7:
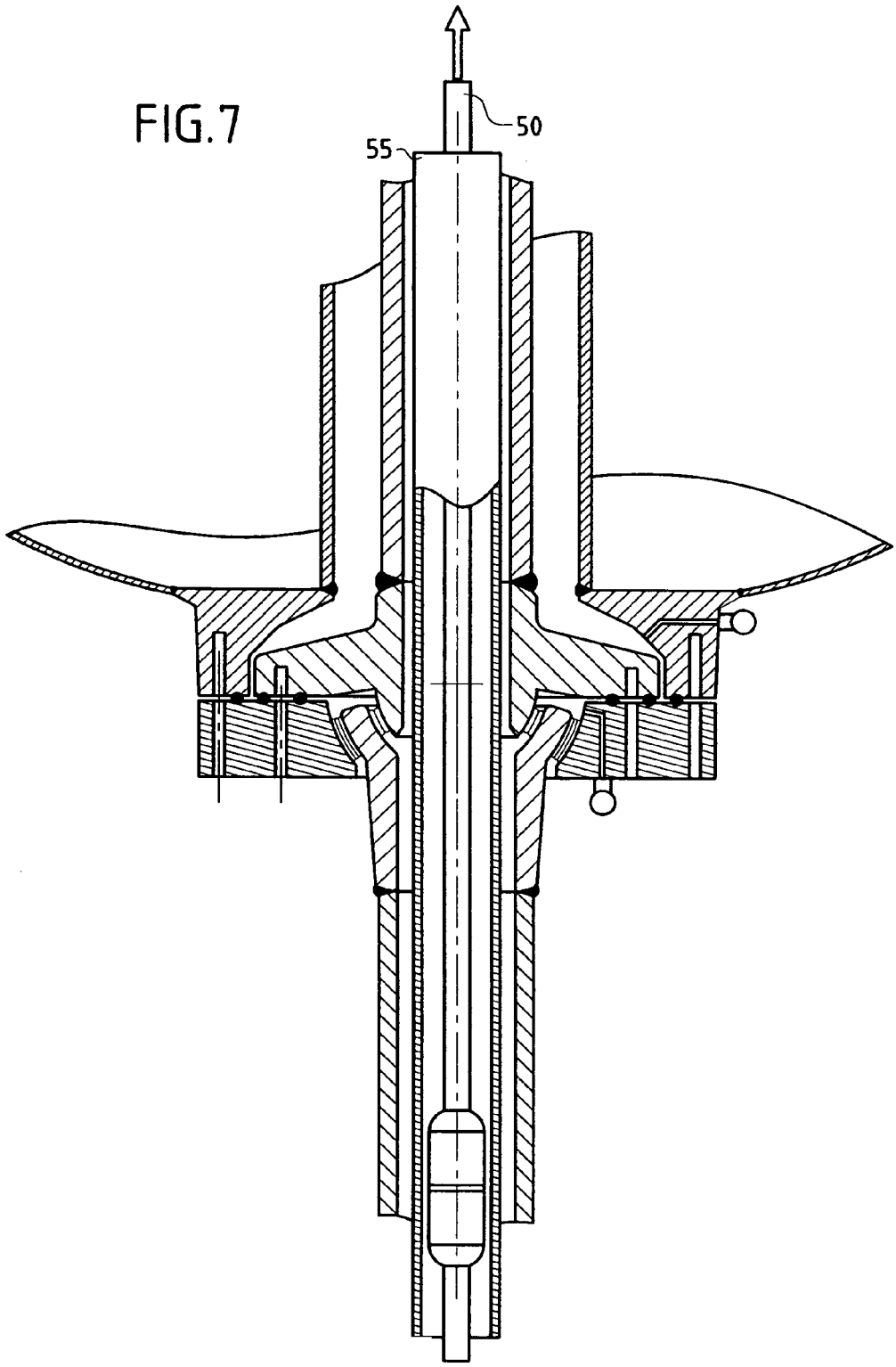
FIG. 7 is a section view of a device of the invention as shown in FIG. 2, further including a second riser for safety purposes having a production line installed therein.

FIG. 7 shows a "double-casing" variant. Inside the riser 1, there is advantageously installed a safety pipe 55 made up of unit lengths that are connected to one another end-to-end by screw fastening. A production line or drill string 50 is situated inside this additional casing.

In this configuration, during drilling operations, mud carrying drilling debris rises to the surface inside said safety pipe 55 and therefore does not come into contact with the riser 1, nor with the laminated abutment 31. This second casing constitutes a primary barrier in the event of pressure rising due to the well erupting or to any other accident, the riser 1 then constituting the outer barrier that serves mainly to withstand the outside pressure due to sea water, and also to the traction exerted by the tensioning buoys. This disposition enables the safety of the installation to be increased considerably, but it presents the drawbacks of increasing its overall weight, which needs to be compensated by increasing the total buoyancy volume.

In FIGS. 6 and 7, the drill strings 50 and the additional casing 55 are continuous through the flexible joint zone situated at the bottom portion of the float. Pivoting through the angle α at the bottom of the float, as shown in FIG. 3, takes place through very small angles, of the order of 2° to 4° at the most, and said drill strings 50 and additional casing 55 can take up the necessary curvature without unacceptable stresses because of the clearance that exists relative to the riser 1, given that they are of much smaller diameter.

Figure 8:
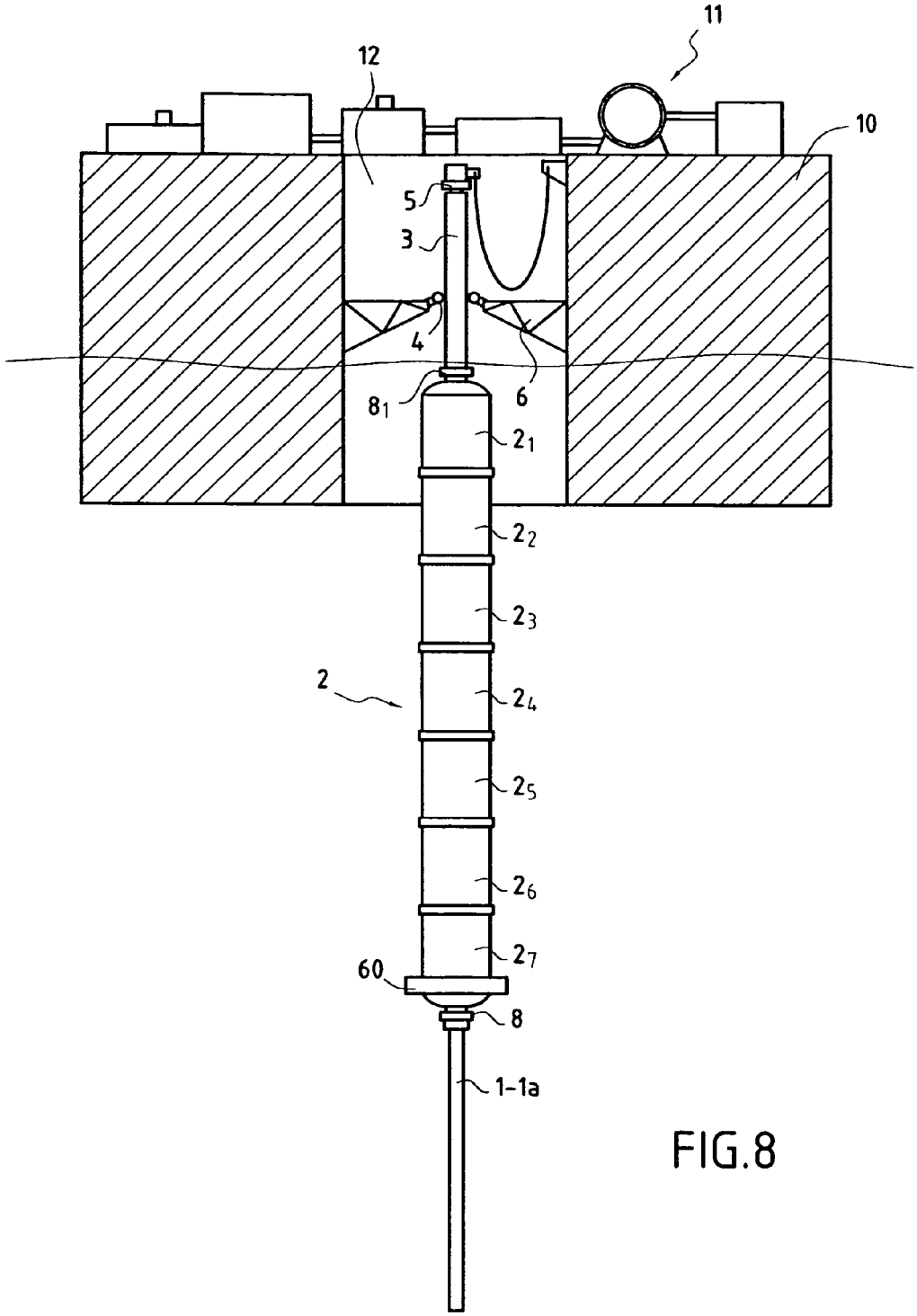
FIG. 8 is a side view similar to FIG. 1, the bottom-to-surface connection device being fitted with an additional mass at the bottom of the float close to the junction device having a leaktight flexible joint.
Figure 9:
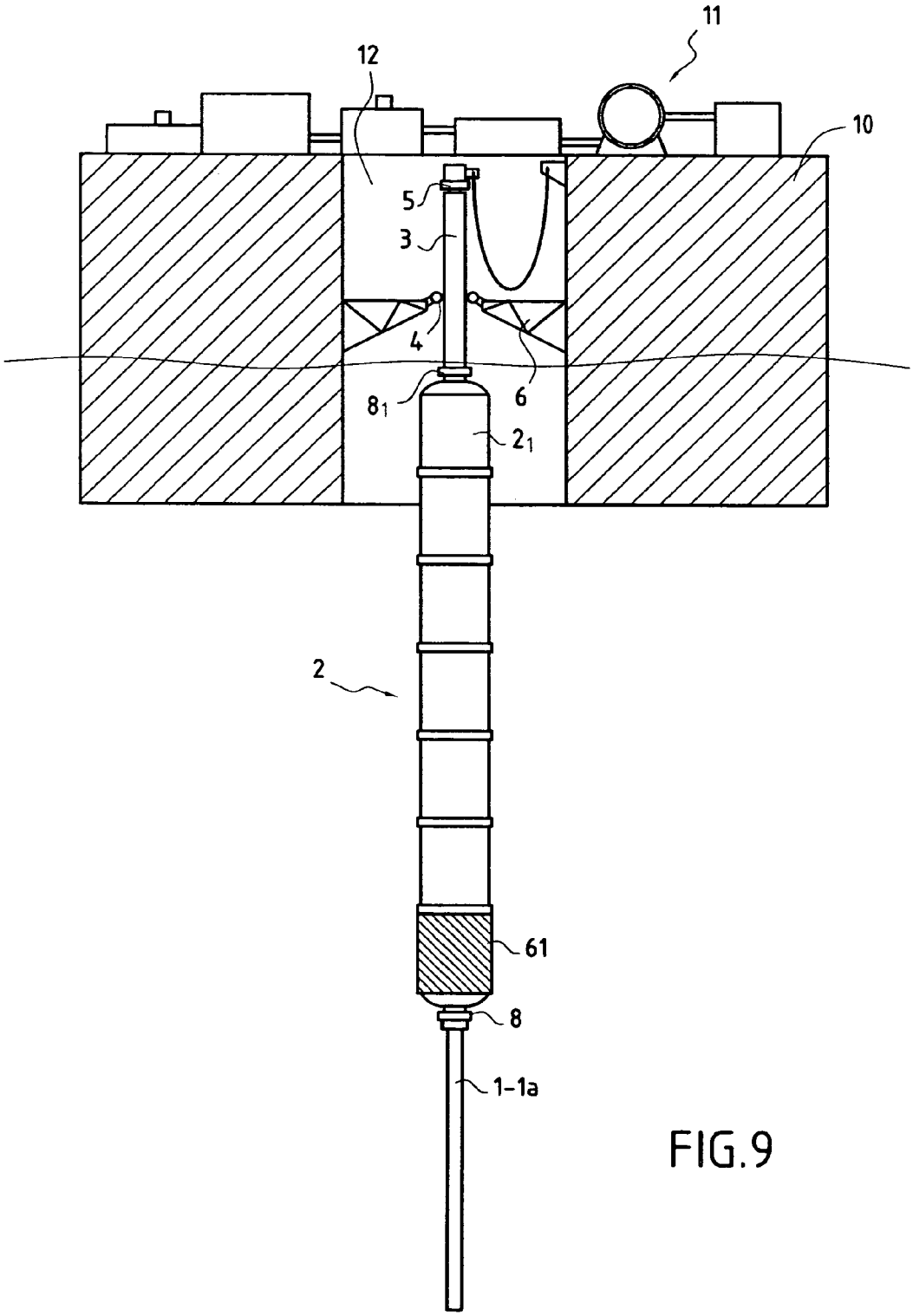
FIG. 9 is a side view similar to FIG. 1, in which the bottom-to-surface connection device is fitted with anti-vortex fins in the bottom portion of the box-type float close to the junction device of the invention having a leaktight flexible joint.

Including a leaktight joint 8 at the bottom of the float does not significantly modify the overall behavior of the assembly with respect to vibration phenomena of the pendulum-guitar type as described in patent WO/2001-53651 in the name of the Applicant, and the appearance of such phenomena is advantageously eliminated by installing as close as possible to said joint either an added peripheral weight 60 situated around the bottom portion of the float 2 as shown in FIG. 8, or antivortex type fins 61 providing a helical ramp 61 surrounding said float 2 in its bottom portion $\mathbf{2}_7$ close to its bottom end, as shown in FIG. 9.

By way of illustration, the dimensions of a junction device 8 of the invention can be as follows:

between the bottom end of the first forged body 22 and the top end of the second forged body 24 the distance is about 60 centimeters (cm);

the inside diameter of the riser 1 is about 400 millimeters (mm);

the outside diameter of said first and second flanges 21 and 23 is about 140 cm; and the nominal diameter of the mean sphere corresponding to the first leaktight abutment 30 is about 70 cm to 90 cm and its thickness is 6 cm to 15 cm depending on the load to be transmitted and the pivot angle α.

Figure 10:
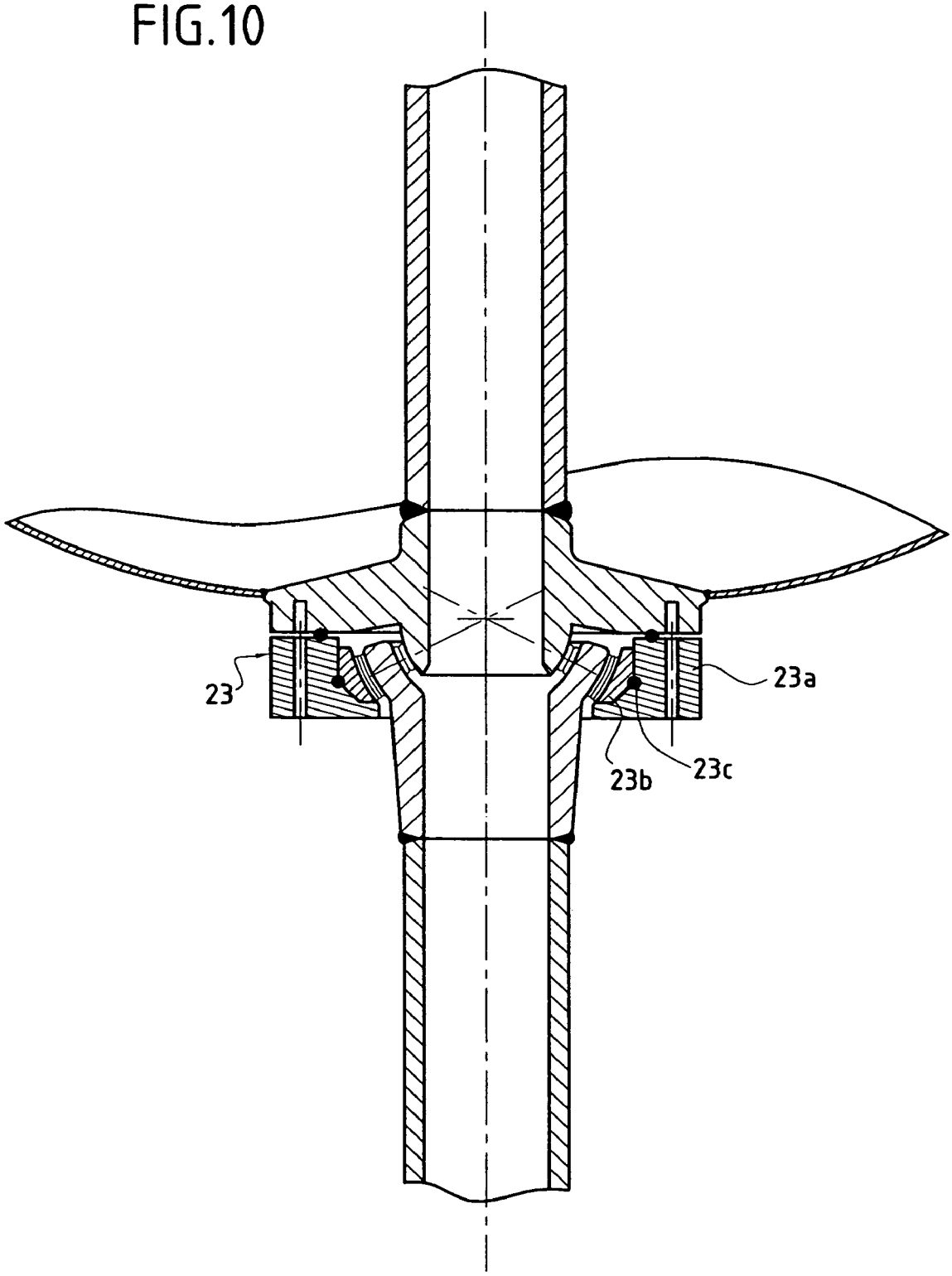
FIG. 10 shows a variant of the connection between the first laminated abutment and the first flange.

In order to simplify fabrication of the first laminated abutment 30, the flange 23 is advantageously made as two portions 23*a* and 23*b* as shown in FIG. 10. An Q-ring 23*c* provides sealing between the two portions. The laminated abutments and the surfaces of the various flanges form bodies and surfaces of revolution that are defined as being spheres of center ○, however it remains within the spirit of the invention if conical shapes are used, as shown in FIG. 11.

Figure 11:
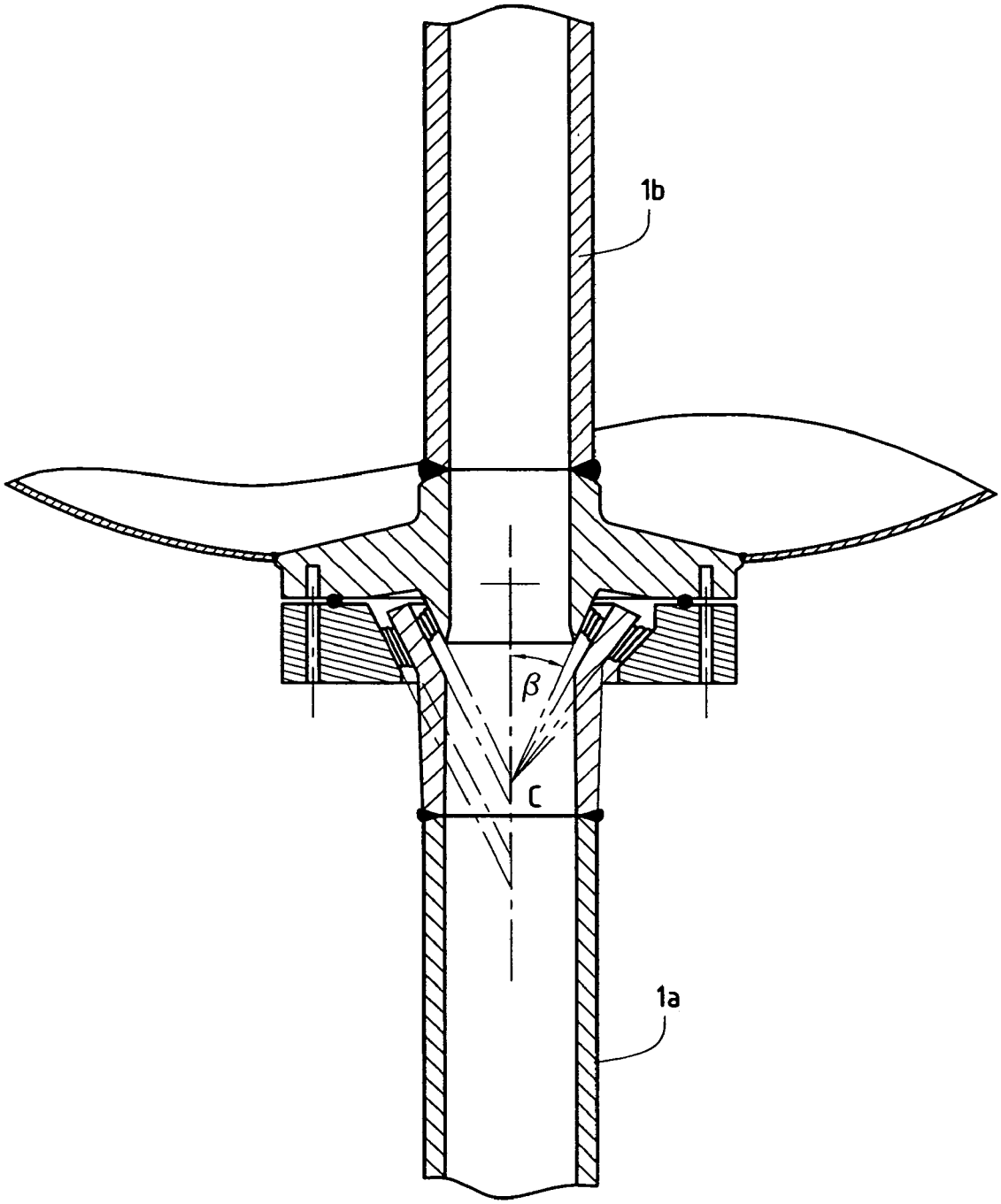
FIG. 11 shows a variant embodiment with surfaces that are frustoconical in shape.

FIG. 11 shows a variant embodiment with the surfaces of spherical shape replaced by surfaces of frustoconical shape.

In the right-hand side of FIG. 11, the apexes of said cones converge substantially on a single point C, with the cones then all being different from one another since the angle at the apex β varies from one cone to another.

In the left-hand side of the same FIG. 11, said cones all have the same angle of the apex β and they are therefore all identical, with the apexes of the various cones then being distributed substantially around the axis ZZ'.

Nevertheless, it is preferred to use shapes that are spherical, since with conical shapes, when the joint takes on a large angle α, the laminated abutments can become pinched and then cease operating in uniform manner.

Said first and second laminated abutments 30 and 31 can accommodate bending through an angle α relative to said longitudinal axis ZZ' having a value lying in the range 0 to 5°, and more usually 0 to 2°.

The junction device 8 of the present invention can be manufactured and put into place using the following sequence:

1) a first layer of uncured elastomer or a first rigid reinforcement, preferably made of metal, is bonded to said inner first surface $\mathbf{23}_1$ of said first flange 23;

2) the various layers of non-cured elastomer and of rigid reinforcement making up said first laminated abutment 30 are installed and bonded in succession;

3) said first forged body 22 is put into place, being bonded via its said outer surface 21 to the last layer or last rigid reinforcement of said first laminated abutment 30;

4) at least one O-ring 28 is put into place on a said top surface of revolution $\mathbf{23}_2$ of said first flange 23;

5) said second forged body 24 is put into place causing it to rest via its said plane bottom surface 241 on said top surface of revolution $\mathbf{23}_2$ of said first flange 23;

6) where appropriate, a first elastomer layer or rigid reinforcement is installed and bonded on said inner second surface $\mathbf{22}_2$ of said first forged body 22 and then the various layers of non-cured elastomer and the various rigid reinforcements of said second laminated abutment 31 are installed in succession;

7) said second forged body 24 is bonded via its said outer second surface $\mathbf{24}_3$ onto the last layer or reinforcement of said second laminated abutment 31;

8) said first flange and said second forged body 24 are united by bolting;

9) the assembly is heated in an oven to cure the various layers of elastomer;

10) the riser portions 1*a* and 1*b* are assembled together in conventional manner by being welded to the respective forged bodies 22 and 24; and then 11) the bottom end of the casing of the last float 20 is welded to the top surface $\mathbf{24}_2$ of the second forged body 24 or to a top surface $\mathbf{21}_1$ of a second flange 21, said flange having a bottom surface $\mathbf{21}_2$, itself bolted to a peripheral portion of said top surface $\mathbf{23}_2$ of said first flange 23 after initially installing at least one O-ring 26 between the two surfaces.

When using frustoconical laminated abutments, i.e. having metal reinforcement and elastomer layers that are frustoconical in shape, these are easier to make since the surface can be developed on a plane, which is not true of other shapes whether they be elliptical, spherical, parabolic, or hyperbolic, which other shapes require precision stamping operations that are more difficult to perform.

In an advantageous embodiment that facilitates installing and assembling the junction device 8 of the invention, said first flange 23 comprises two portions 23*a* and 23*b*, in which the first portion 23*a* is a body of revolution including said inner first surface $\mathbf{23}_1$, and said second portion 23*b* is a peripheral flange comprising said top surface $\mathbf{23}_2$, said second portion 23*b* being secured in leaktight and reversible manner to said first portion 23*a* via at least one O-ring 29 by securing said top surface portion $\mathbf{23}_2$ of the first flange 23 in leaktight and reversible manner to said bottom surface $\mathbf{24}_1$ of said second forged body 24.

In an advantageous embodiment, the junction device 8 is put into place and manufactured by bonding said first laminated abutment 30 onto a first portion 23*a* of said first flange 23, said first portion 23*a* being a body of revolution including an inner surface corresponding to said inner first surface of revolution $\mathbf{23}_1$.

The following assembly steps are then performed:

1) said first laminated abutment 30 is bonded to said body of revolution 23*a;*

2) the first forged body 22 is bonded via its said outer surface $\mathbf{22}_1$ to the free face of said laminated abutment 30;

3) said second laminated abutment 31 is bonded to said inner second surface $\mathbf{22}_2$ of the first forged body 22;

4) said outer second surface of revolution $\mathbf{24}_3$ of the second forged body 24 is bonded to the free face of said second laminated abutment 31;

5) the assembly is put into an oven in order to cure the various layers of elastomer; and then 6) a second portion 23*b* of said first flange 23 comprising both said top surface portion $\mathbf{23}_2$ co-operating in leaktight manner via an O-ring 28 with said bottom surface $\mathbf{24}_1$ of the second forged body 24, and also a concave surface 23*c* capable of co-operating with the free outer face of said first portion 23*a* via an O-ring 29 is bolted to the second forged body 24, and where appropriate to a said second flange 21, the first portion 23*a* of the first flange 23 thus also being prevented from moving and the entire junction device 8 thus being united.

The advantage of this embodiment is that it makes it possible to verify that the layers constituting the edges 30*a* and 31*a* of said first and second laminated abutments 30 and 31 have been properly cured.

The forged bodies 22 and 24 and the flanges 21 and 23 are described as being bodies of revolution, however it would remain the spirit of the invention for those parts to present external shapes that are polygonal or irregular, it-is only the surfaces $\mathbf{23}_1$, $\mathbf{22}_1$, $\mathbf{22}_2$, and $\mathbf{24}_3$ which receive the laminated abutments that need to be substantially spherical about a center ○, or ellipsoidal, or indeed conical, as described above.

The invention claimed is:

1. A bottom-to-surface connection device comprising at least one undersea pipe or riser including at least one float, said at least one float being connected at its bottom end to a junction device creating a leaktight flexible joint between the bottom end of the float and said riser wherein said junction device is interposed between and secured to a bottom portion of the riser going down to the sea bottom and a top portion of the riser passing through said float and rising to the surface, said junction device comprising:

a first forged body of revolution secured to the top end of said bottom portion of the riser, and forming an internal tubular duct section having substantially the same diameter as said bottom portion of the riser; and a second forged body of revolution secured to the bottom end of said top portion of the riser, and forming an internal tubular duct section having substantially the same diameter as said top portion of the riser;

said first and second forged bodies being interconnected in flexible and leaktight manner by at least a first flange in the form of a body of revolution secured in leaktight and reversible manner to said second forged body and connected to said first forged body by at least a first laminated abutment in the form of a body of revolution, comprising a plurality of elastomer layers interposed between rigid reinforcements defining surfaces of revolution having the same axis as the common longitudinal axis of revolution ZZ' of said first and second forged bodies and said first flange, said surfaces of revolution being frustoconical in shape or skew surfaces comprising surfaces of sections that are ellipsoidal or parabolic or hyperbolic.

2. The bottom-to-surface connection device according to claim 1, comprising an undersea pipe or riser tensioned by at least one float constituted by a can presenting a cylindrical casing surrounding said pipe coaxially, located on the high underwater portion of said pipe, said pipe including a said junction device for said can, wherein:

said first forged body presents in its top portion an outer first surface of revolution that is one of frustoconical in shape and of ellipsoidal section; and said second forged body of revolution secured to the bottom end of said top portion of the riser, presents in its bottom portion a bottom first surface; and said first flange presents:

an inner first surface of revolution of one of frustoconical shape and of ellipsoidal section, said inner first surface of the first flange and said outer first surface of the first forged body being situated facing each other and co-operating elastically and in leaktight manner via said first laminated abutment in the form of a body of revolution that is one of frustoconical in shape and of ellipsoidal section, comprising a plurality of layers of elastomer sandwiched between rigid steel reinforcing sheets, bonded to said inner first surface and said outer first surface thus bonding together said first flange and said first forged body; and at least a portion of a top surface of said first flange cooperating in leaktight manner, with said bottom surface of said second forged body of revolution, said top surface portion of said first flange and said top surface of said second forged body being secured to each other in leaktight and reversible manner; and said outer casing of the float being secured to one of a top surface of said second forged body and a top surface of a second flange in the form of a body of revolution having a bottom surface, itself bonded in leaktight and reversible manner, via at least one O-ring, to a portion of said top surface of revolution of said first flange.

3. The device according to claim 2, wherein said first abutment said outer first surface of the first forged body and said inner first surface of the first flange are frustoconical in shape about the same said axis of revolution ZZ', with an angle of the apex β lying in the range 30° to 80°, the apexes of the various frustoconical surfaces being situated below said frustoconical surfaces, and the various frustoconical surfaces sharing one of a common angle at the apex β and a common apex.

4. The device according to claim 2, wherein said outer casing of the float is secured to an internal second pipe of greater diameter than said riser and wherein the device includes said second flange in the form of a body of revolution to which the bottom end of said outer casing of the float and the bottom end of said internal second pipe are secured, by welding, said second flange surrounding said second forged body so that a second inner chamber is defined by an inner surface of revolution of said second flange having the same axis of revolution ZZ', by said top surface of revolution of said second forged body, by the cylindrical outer surface of said top portion of the riser and the cylindrical inside surface of said internal second pipe, and by a closure flange at the top ends of said internal second pipe and of said top portion of the riser.

5. The device according to claim 2, wherein said top surface peripheral of the first flange and said bottom surface of the second forged body, are annular plane surfaces.

6. The device according to claim 4, wherein said internal second pipe extends above said float, and a holding and guide device serves to guide said internal second pipe relative to said floating support.

7. The device according to claim 1, wherein said second forged body of revolution includes in its bottom portion an outer second surface of one of frustoconical shape ellipsoidal section, and said outer second surface of revolution is situated facing and co-operates elastically and in leaktight manner with an inner second surface of revolution of one of frustoconical shape of and ellipsoidal section, said inner second surface being situated in the top portion of said second forged body, and said inner second surface being connected to said outer second surface via a second laminated abutment in the form of a body of revolution constituted by a plurality of elastomer layers sandwiched between rigid reinforcing sheets, that are one of frustoconical in shape and ellipsoidal section, and that are bonded to said outer second surface and to said inner second surface.

8. The device according to claim 1, wherein said first abutment is of ellipsoidal section substantially centered on the point O situated above said surface and on said axis of revolution ZZ'.

9. The device according to claim 1, wherein said first and second forged bodies and said first flange define a first internal chamber which co-operates with pressure sensor means for monitoring the pressure inside said chamber.

10. The device according to claim 9, wherein said first internal chamber is defined by the top portion of said first forged body and by free portions of a bottom surface of revolution of said second forged body, said inner first surface of revolution of said first flange, and said outer second surface of revolution of said second forged body.

11. The device according to claim 1, wherein the top end of the float is secured to one of the top portion of the riser and said internal second pipe via a rigid junction.

12. The device according to claim 1, wherein said float is a single float extending over a length of approximately 40 m to approximately 100 m in order to confer buoyancy enabling substantially the entire bottom-to-surface connection to be tensioned.

13. The device according to claim 1, wherein the buoyancy of said undersea pipe is provided by said float without adding any additional tensioning system that is secured to the floating support.

14. The device according to claim 1, further comprising stabilizer means in the bottom portion of the float for at least one of increasing the mass of water the device entrains when it moves, and lowering the center of gravity of the top portion of the pipe in the float.

15. The device according to claim 14, wherein said stabilizer means comprise a helical ramp surrounding the bottom portion of said float close to its bottom end.

16. The device according to claim 14, wherein said stabilizer means comprises an additional peripheral mass situated around the bottom portion of the float.

17. The device according to claim 1, wherein said first flange comprises two portions in which the first portion is a body of revolution including said inner first surface, and said second portion is a peripheral flange including, top surface of said first flange, said second portion being secured in leaktight and reversible manner to said first portion via at least one O-ring by securing in leaktight and reversible manner said top surface of the first flange to a bottom surface of said forged second body.

* * * * *